US006840221B1

(12) United States Patent
Rowells et al.

(10) Patent No.: US 6,840,221 B1
(45) Date of Patent: Jan. 11, 2005

(54) RUNNERLESS ENGINE INTAKE MANIFOLD HAVING INTEGRAL FUEL DELIVERY GROOVE OR BORE

(75) Inventors: Robert L. Rowells, Elmwood Park, IL (US); Gregory J. Saele, Itasca, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/775,784

(22) Filed: Feb. 10, 2004

Related U.S. Application Data

(63) Continuation-in-part of application No. 10/745,435, filed on Dec. 23, 2003.

(51) Int. Cl.[7] ..... F02M 35/10; F02M 55/02

(52) U.S. Cl. ..... 123/456; 123/468; 123/184.21; 123/184.42; 123/184.61

(58) Field of Search ..... 123/184.21, 184.34, 123/184.38–184.45, 184.47, 184.61, 456, 468, 469

(56) References Cited

U.S. PATENT DOCUMENTS

| | | | | | |
|---|---|---|---|---|---|
| 5,062,405 | A | * | 11/1991 | Daly | 123/468 |
| 5,333,581 | A | * | 8/1994 | Cagle | 123/193.5 |
| 5,682,859 | A | * | 11/1997 | Wakeman | 123/470 |
| 6,167,855 | B1 | * | 1/2001 | Mammarella et al. | 123/90.38 |
| 6,308,686 | B1 | * | 10/2001 | Mammarella et al. | 123/470 |
| 6,742,489 | B2 | * | 6/2004 | Vichinsky | 123/184.21 |
| 6,758,191 | B2 | * | 7/2004 | Vanderveen et al. | 123/456 |
| 2002/0083924 | A1 | * | 7/2002 | Murphy | 123/468 |

* cited by examiner

*Primary Examiner*—Weilun Lo
(74) *Attorney, Agent, or Firm*—Susan L. Lukasik; Dennis Kelly Sullivan; Jeffrey P. Calfa

(57) ABSTRACT

In one embodiment, a cylinder head (10) and a runnerless intake manifold (12) are assembled together and cooperatively define an air manifold (14) and a fuel manifold (16) for supplying air and fuel respectively to engine cylinders in an engine block to which cylinder head (10) is fastened. In another embodiment, the air manifold is the same, but the fuel manifold (66) is defined by a bore (68) and holes (70) in the intake manifold (60).

9 Claims, 6 Drawing Sheets

RUNNERLESS ENGINE INTAKE MANIFOLD HAVING INTEGRAL FUEL DELIVERY GROOVE OR BORE

PRIORITY CLAIM

This application claims the priority and is a continuation-in-part of non-Provisional application Ser. No. 10/745,435, filed Dec. 23, 2003.

FIELD OF THE INVENTION

This invention relates to internal combustion engines, particularly to engine air and fuel systems.

BACKGROUND OF THE INVENTION

An air system of an internal combustion engine conveys combustion air to combustion chambers where the air forms part of an air-fuel mixture that is compressed and combusted to power the engine. Combustion chambers of an in-line, reciprocating piston engine are cylinders that are cooperatively defined by a succession of parallel cylinder bores and a cylinder head that closes open ends of the cylinder bores. When such an engine has a cylinder block, the cylinder head is fastened and sealed to a face of the block containing the open cylinder bore ends. When such an engine is a wet sleeved engine, the cylinder head is fastened and sealed to the crankcase and the open ends of the sleeves that form the cylinder bores. Intake valves mounted on the cylinder head open at proper times during engine cycles to allow air that has passed through the air system to be admitted to the cylinders.

A fuel system of a diesel engine comprises fuel injectors that inject fuel into engine cylinders at proper times during engine cycles. Fuel under pressure may be delivered to the fuel injectors through a fuel manifold, or fuel rail, that serves multiple fuel injectors.

An intake manifold is a part of an engine air system that associates with a cylinder head to distribute air to the engine intake valves. Known intake manifolds comprise runners from a plenum to the intake valves of individual engine cylinders.

Fuel rails and intake manifolds are typically separate parts.

SUMMARY OF THE INVENTION

Briefly, the present invention relates to improvements in air and fuel delivery in an intake manifold mounted on a cylinder head in an internal combustion engine. The improvements arise through integration of certain features in the intake manifold in cooperation with its mounting on the head. Various economies and savings are obtained as a result.

The foregoing, along with further features and advantages of the invention, will be seen in the following disclosure of a preferred embodiment of the invention depicting the best mode contemplated at this time for carrying out the invention. This specification includes drawings, now briefly described as follows.

DESCRIPTION OF THE PREFERRED EMBODIMENT

An internal combustion engine embodying principles of the present invention comprises a cylinder head 10 and a runnerless intake manifold 12. When the latter is assembled to the former as in FIGS. 2 and 4, the two parts cooperatively define an air manifold 14 and a fuel manifold 16 for supplying air and fuel respectively to the engine cylinders (not shown) whose open ends are closed by cylinder head 10. Head 10 is representative of a design for an in-line, six-cylinder diesel engine.

Figure 1:
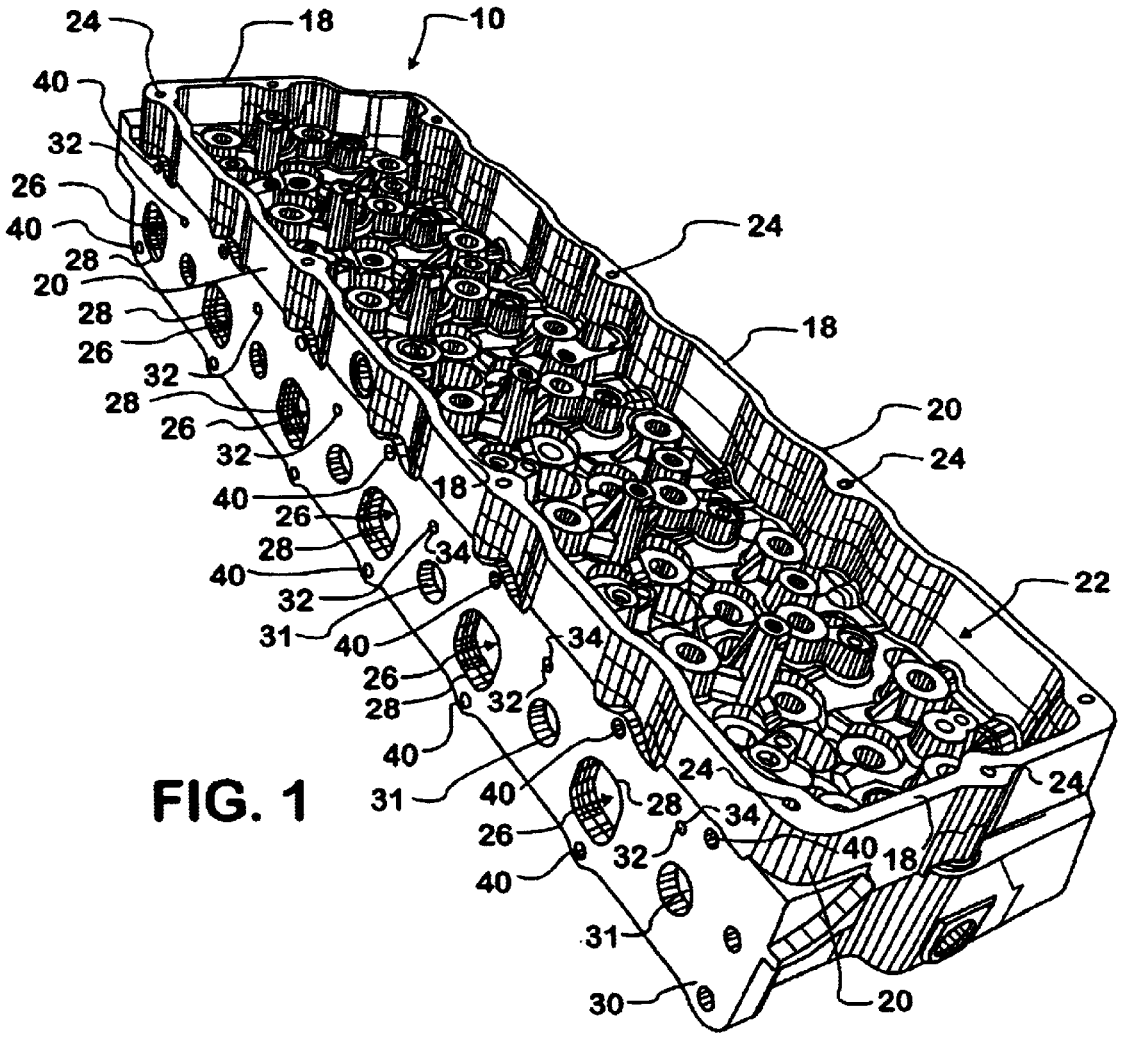
FIG. 1 is a perspective view of a cylinder head by itself.
Figure 2:
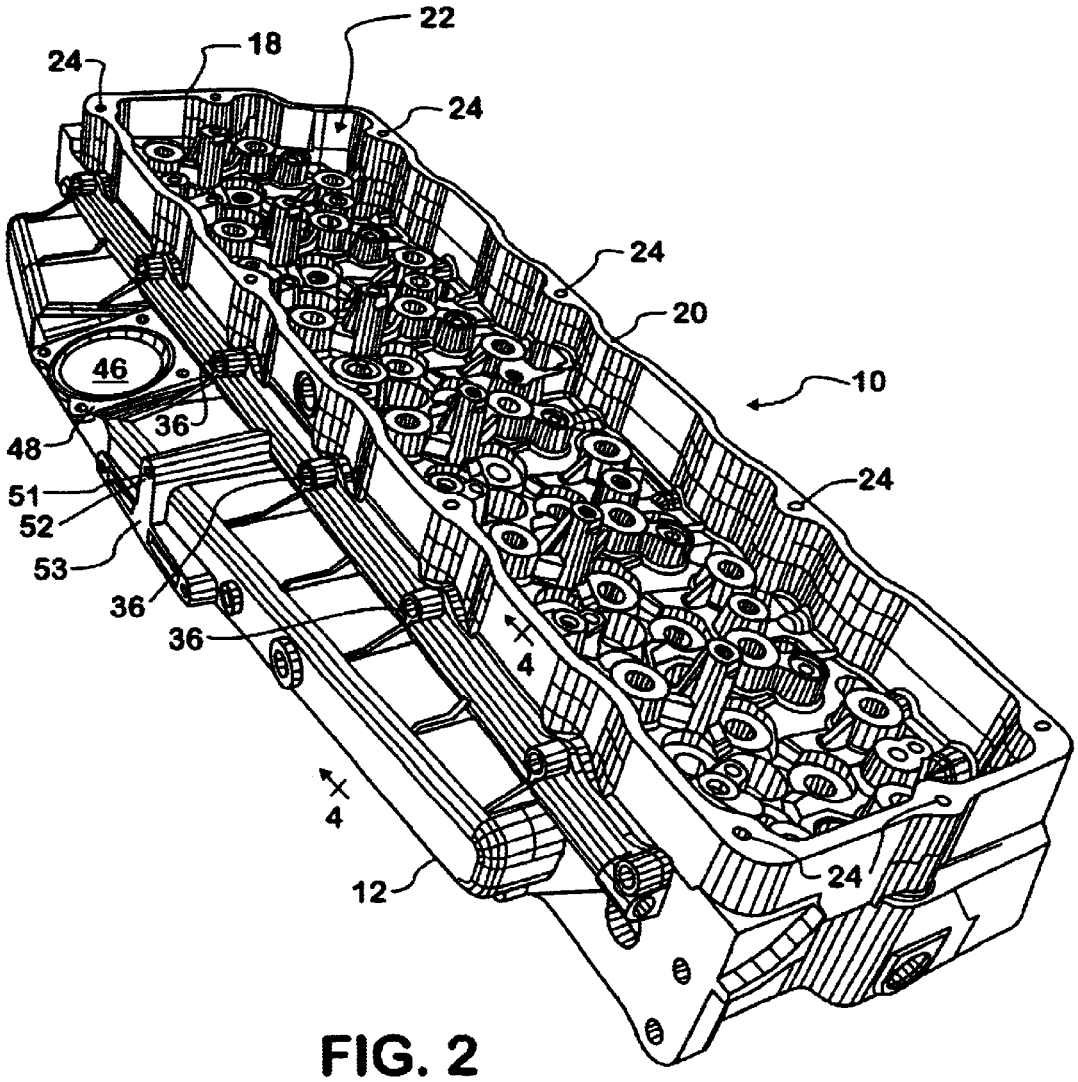
FIG. 2 is a perspective view of the cylinder head with an associated intake manifold.

As can be understood from FIGS. 1 and 2, head 10 is shown without intake and exhaust valves for the respective cylinders, but both Figures show features of construction for accepting the valves and related mechanism for operating them. Head 10 comprises a generally upright rectangular perimeter wall 20 surrounding an open space 22. Wall 20 has a flat edge surface 18 to which a mating edge of a valve cover (not shown) fits to enclose space 22 where the valve operating mechanism is located. When head 10 is assembled into a wet sleeved engine to close the open ends of the sleeves, head 10 seals to the sleeves and crankcase. Head 10 comprises a series of tapped blind holes 24 in wall 20 via which fasteners (not shown) attach the valve cover to the head.

Head 10 further comprises six air ports 26 having entrances 28 in a surface 30 that continues from one of the two longer sides of wall 20 in the direction away from edge 18. Entrances 28 are spaced apart along the length of surface 30. Each port 26 forms a passageway that extends within head 10 from its entrance 28 to an entrance of the intake valve (or valves in the case of a multi-valve engine) of the corresponding cylinder. Plugged core clean-out holes 31 are shown in FIG. 1, but they do not pertain to the subject matter of this invention.

Head 10 further comprises six fuel ports 32 having entrances 34 in surface 30. Entrances 34 are spaced apart along the length of surface 30 on an imaginary straight line that is spaced from the nearest edges of air port entrances 28. Each port 32 forms a passageway that extends within head 10 from its entrance 34 to an exit that opens to the fuel inlet of a respective fuel injector (not shown) for the respective cylinder.

Figure 3:
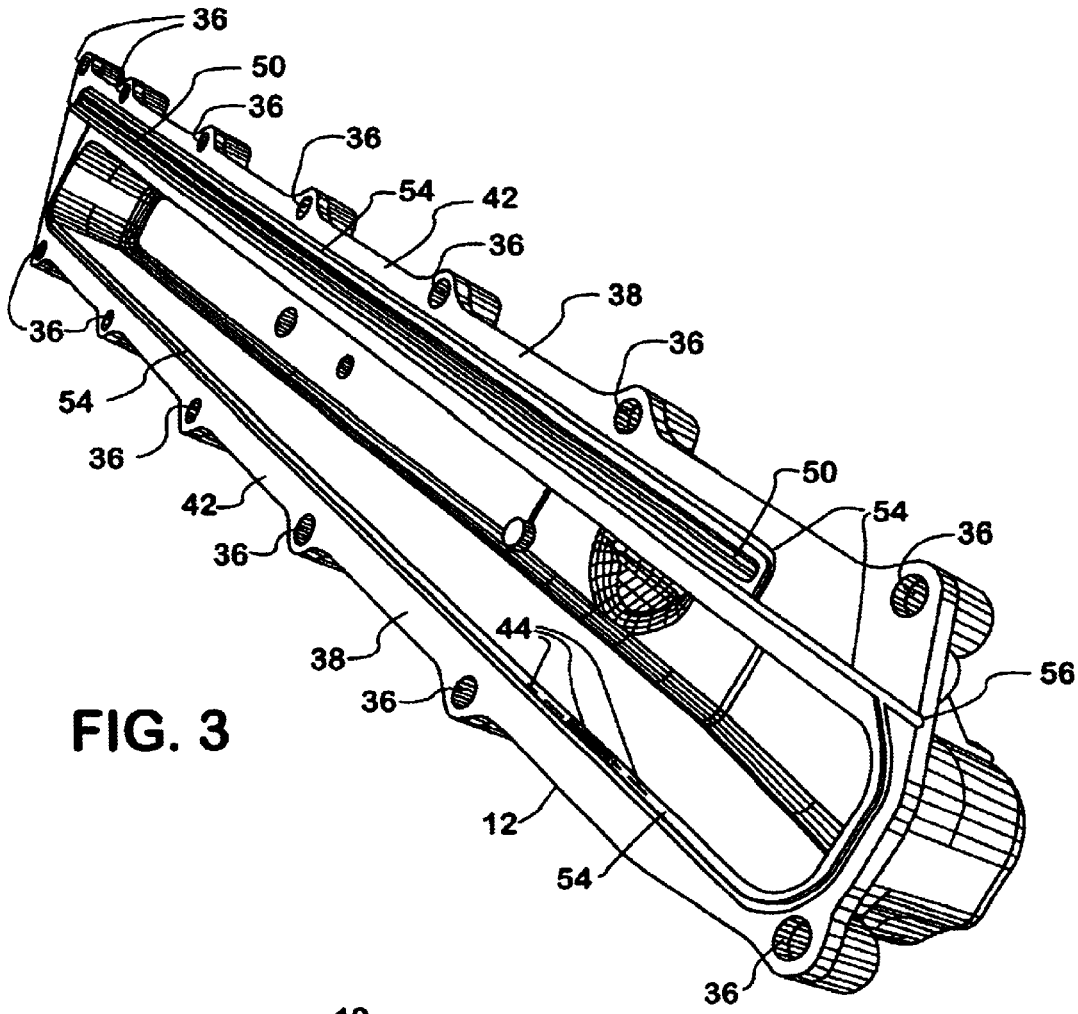
FIG. 3 is a perspective view of the intake manifold by itself in the direction of its interior.

Air manifold 14 is formed by constructing intake manifold 12 to have a walled hollow interior space that is open to all air ports 26 with manifold 12 assembled to head 10. Fasteners (not shown) pass through holes 36 in bosses in a perimeter flange 38 and are tightened in threaded holes 40 extending into head 10 from surface 30. This forces a surface 42 of perimeter flange 38 against surface 30, with an endless portion of a one-piece seal 44 that has been disposed between the two surfaces sealing around air manifold 14. Seal 44 is only partially shown in FIG. 3 for clarity of illustration.

Intake manifold 12 further comprises an air inlet 46 that is provided by a circular through-hole somewhere along the length of air manifold 14 in one of the walls enclosing the hollow interior space that forms air manifold 14. At air inlet 46 the exterior of that wall has an attachment face 48 for attaching a part (not shown) of the air system through which air is introduced into air manifold 14. In this way, air passing through the air system is distributed to the individual air ports 26 in head 10 without an individual runner to each air port.

Fuel manifold 16 is formed by constructing intake manifold 12 to have a groove 50 that runs along a portion of flange 38 in surface 42 and is open to all fuel ports 32. With surfaces 42 and 30 being forced together by the fastening of intake manifold 12 to head 10, another endless portion of seal 44 seals around fuel manifold 14.

Fuel from a source such as a pump is introduced into fuel manifold 16 through a fuel inlet port 52 that has an entrance 51 at a fuel filter mounting pad surface 53 on the exterior of intake manifold 12. Port 52 forms an internal passageway that extends within the wall of intake manifold 12 to intersect groove 50. In this way, fuel passing through the fuel system is filtered by a filter (not shown) on pad surface 53, introduced into port 52 where it is conveyed to groove 50 for distribution to the individual fuel ports 32 in head 10 without an individual runner or line to each fuel port.

Seal 44 fits into a groove 54 in surface 42. The seal is a single piece having two endless portions, one of which seals around air manifold 12 and the other of which seals around fuel manifold 14. It can be understood that in such a one-piece seal the two endless portions share a common segment of the seal between the two manifolds 12, 14. Hence the layout of seal 44 matches that of groove 54, but the groove layout also has a shunt 56 not occupied by seal 44. In the unlikely event that seal 44 were mistakenly omitted or improperly placed before intake manifold 12 and head 10 were assembled together, shunt 56 would be effective to shunt leaking fuel away from air manifold 14.

Figure 4:
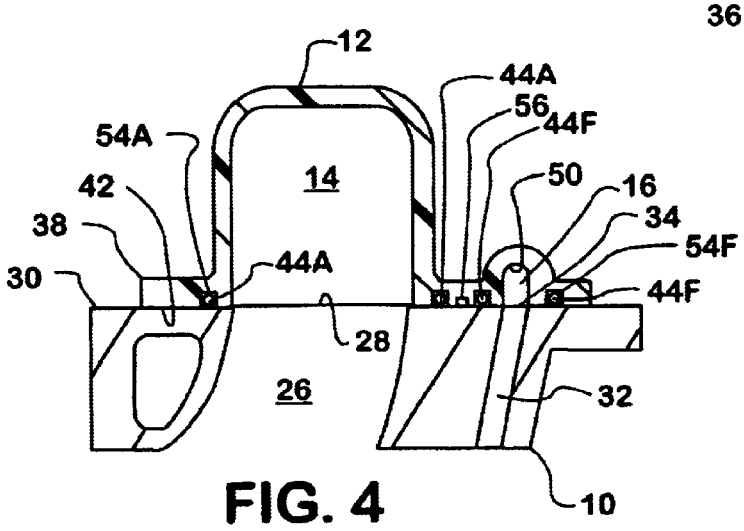
FIG. 4 is a cross section view taken along section line 4—4 in FIG. 2, but showing a modified embodiment.

FIG. 4 is representative of a modified embodiment that has two separate seals 44A, 44F. Intake manifold 12 has two separate seal grooves 54A, 54F in surface 42. Each seal groove 54A, 54F surrounds a respective one of manifolds 14, 16, with each endless seal 44A, 44F fitting in a respective groove 54A, 54F. Running parallel with the long dimension of each seal groove, and between the two seal grooves, in surface 42, is a groove that forms a shunt 56 that serves the same purpose as shunt 56 in the embodiments of FIG. 1, 2, and 3. Leaking fuel from fuel manifold 16 will be carried away from air manifold 14 by shunt 56.

Figure 5:
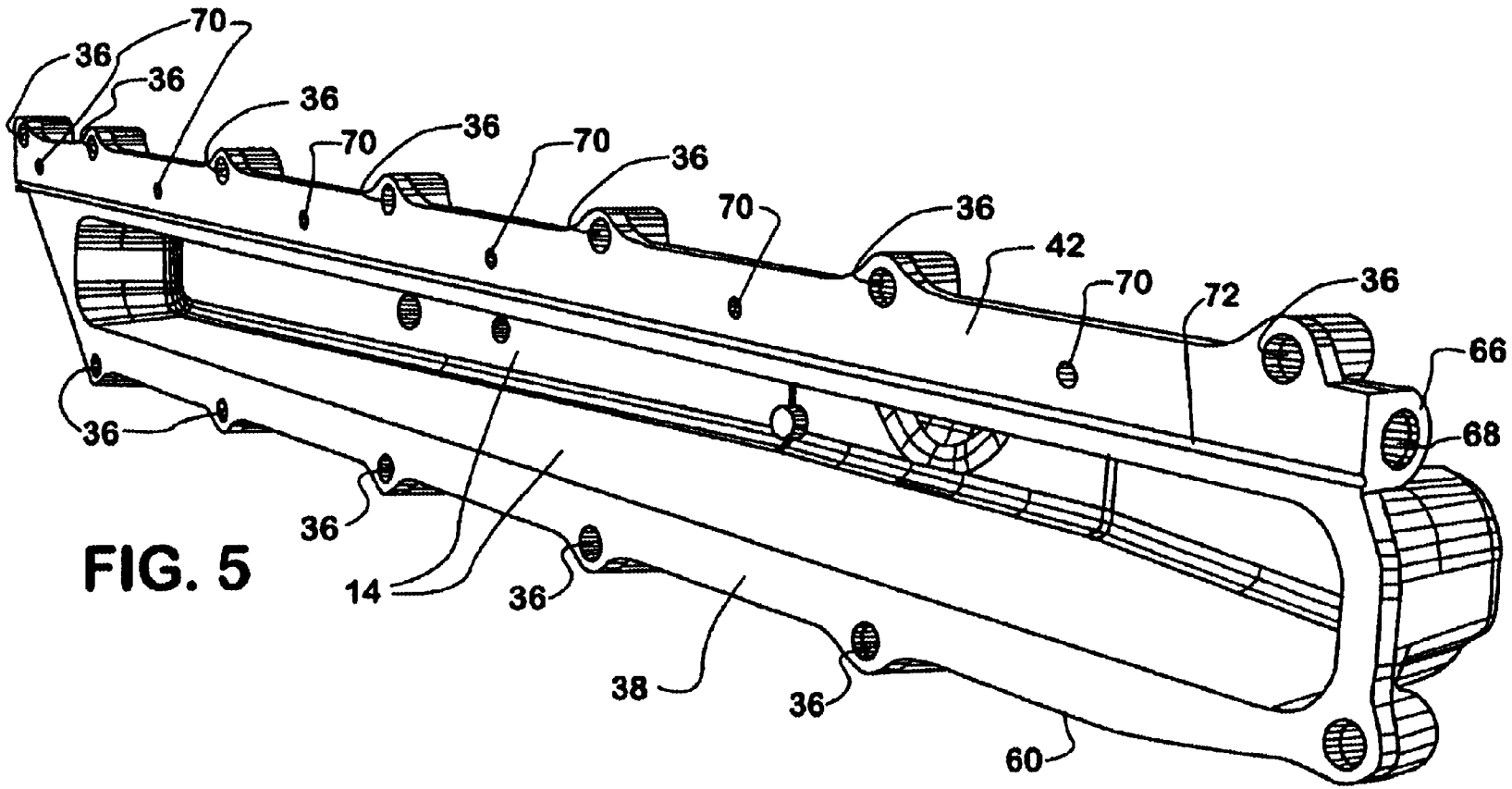
FIG. 5 is a perspective view of another embodiment of inventive intake manifold by itself in the direction of its interior.
Figure 6:
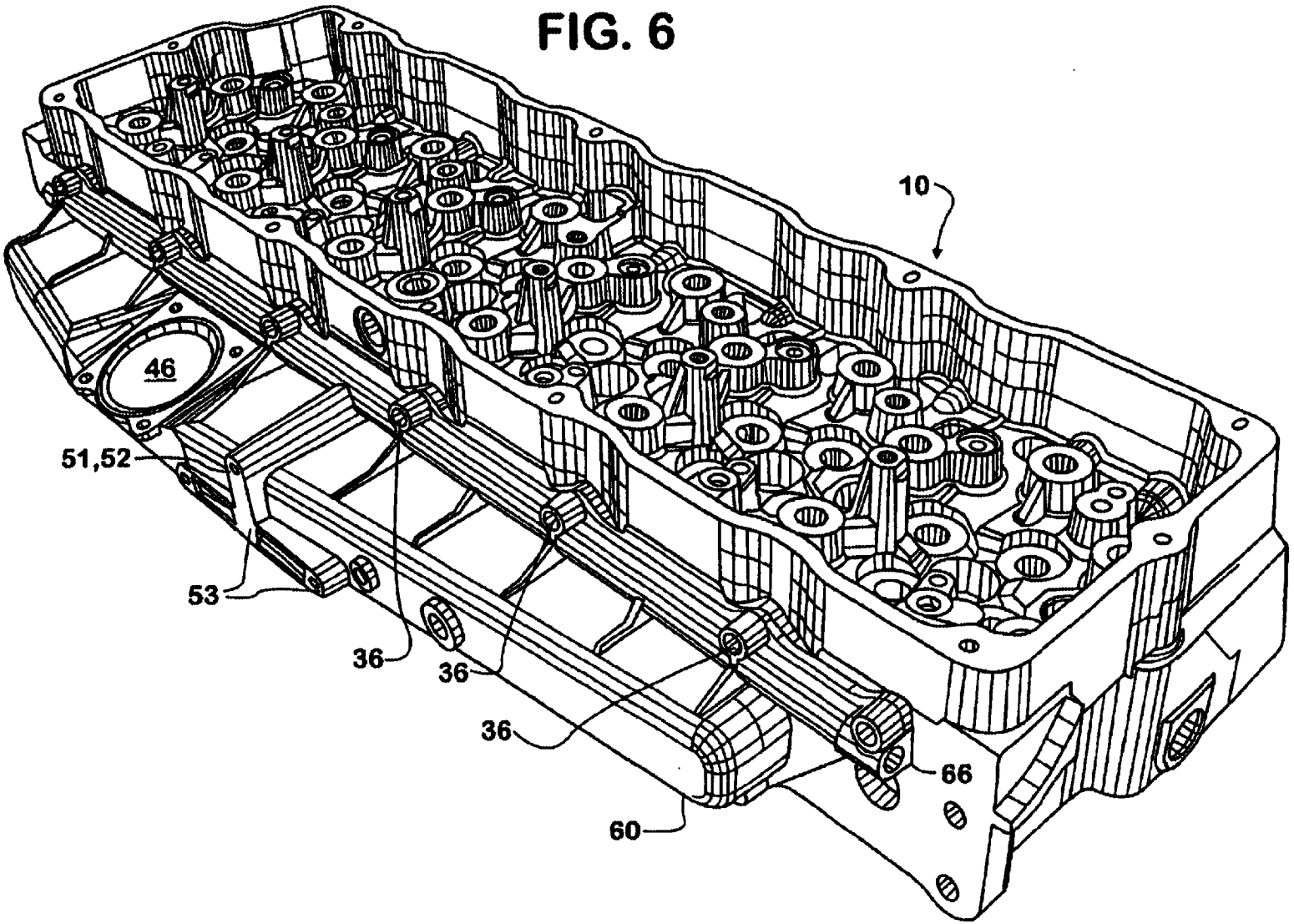
FIG. 6 is a perspective view of the intake manifold of FIG. 5 mounted on a cylinder head.

FIGS. 5 and 6 illustrate another embodiment of runnerless intake manifold 60 for cylinder head 10. Like references numerals serve to identify like elements in the respective embodiments. Manifold 60 is like manifold 12 in most respects, except for its fuel manifold 66, which is rather different. Fuel manifold 66 is not cooperatively defined by intake manifold 60 and cylinder head 10, but rather comprises a circular bore 68 running lengthwise through manifold 60. Although bore 68 is open at opposite ends, one of those ends (the near end in FIG. 5 which is the far end in FIG. 6) is closed by a plug, while the other end (the near end on FIG. 6) is open for connection to a fuel supply line (not shown). The portion of perimeter flange 38 that overlies ports 32 in cylinder head 10 is enlarged to allow bore 68 to be created in intake manifold 60.

At locations corresponding to the locations of entrances 34 of ports 32 in cylinder head 10, intake manifold 60 comprises holes 70 that extend from surface 42 to bore 68. When intake manifold 60 and cylinder head 10 are assembled together in an engine, holes 70 register with entrances 34. Fuel introduced into bore 68 at its fuel inlet end will fill bore 68 and pass through holes 70 to ports 32, thereby supplying the fuel injectors.

Surface 42 comprises a leak groove 72 running lengthwise of intake manifold 60. It lies between holes 70 and air manifold 14 and is open at opposite ends. Leak groove 72 serves the same purpose as shunt 56, shunting leaking fuel away from air manifold 14 in the unlikely event that a seal were mistakenly omitted or improperly placed before intake manifold 60 and head 10 were assembled together.

Figure 7:
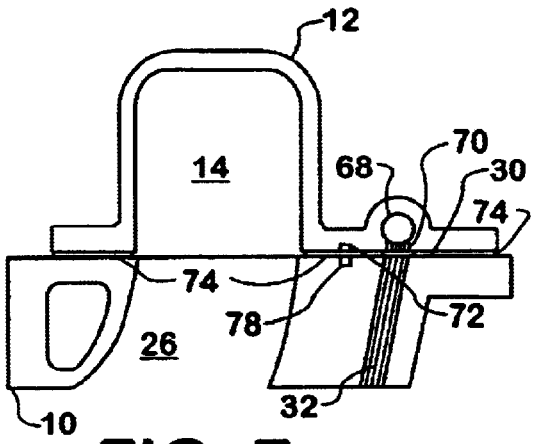
FIG. 7 is a cross section view taken along section line 7—7 in FIG. 6 to illustrate one type of sealing arrangement for sealing between the intake manifold and the cylinder head.

FIG. 7 shows the use of a single flat gasket seal 74 sandwiched between surfaces 30 and 42. Seal 74 has two elongated loops, one encircling the joint between air manifold 14 and cylinder head 10 and the other encircling the joint between the zone in surface 42 that contains holes 70 and cylinder head 10. The two loops share a common run 76 that covers leak groove 72 and a groove 78 in surface 30 of cylinder head 10.

Figure 8:
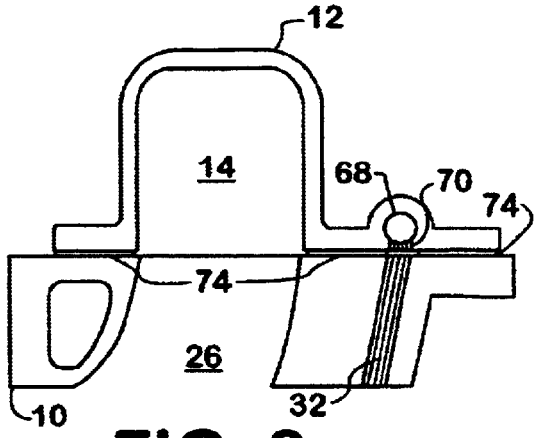
FIGS. 8, 9, 10, and 11 are views similar to FIG. 7 showing other types of sealing arrangements.

FIG. 8 shows a modification where grooves 72 and 78 are not present.

Figure 9:
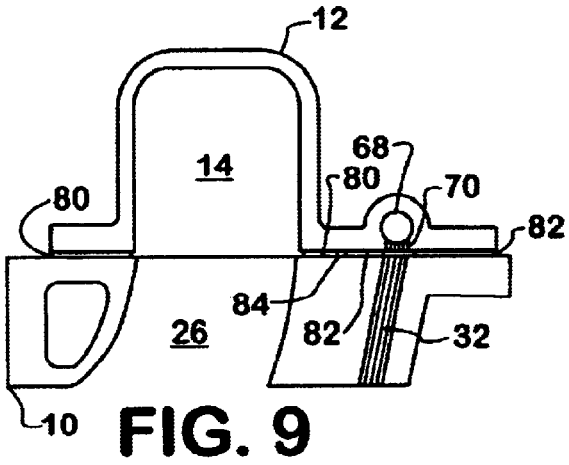

FIG. 9 shows another modification where two separate seals 80 and 82 respectively encircle the air manifold and the zone in surface 42 that contains holes 70. A gap 84 is present between the two seals.

Figure 10:
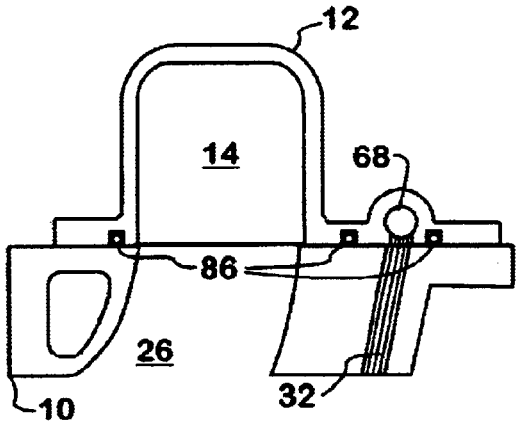

FIG. 10 shows another modification using a single seal 86 like seal 44 seated in a groove in surface 42, but without a leak groove 72.

Figure 11:
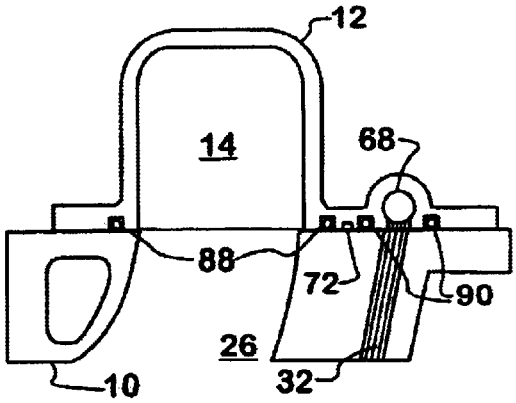

The modification shown in FIG. 11 is like FIG. 4 in that it uses two separate seals like 88, 90 in respective grooves with a leak groove between them.

The embodiments that have been described and illustrated are for a non-return, or dead-headed, type fuel system. Principles of the invention can be applied to other types of fuel systems, not specifically shown by a drawing Figure. Such systems may have one or more additional bores and/or grooves in the intake manifold that are parallel with bore 68 and/or groove 50.

Because only a single manifold part that delivers both fuel and air need be assembled to the head, the invention provides a number of advantages including savings in machining operations, assembly time, space, fasteners, servicing, and parts inventory. An intake manifold 12 may be fabricated by known manufacturing methods using known materials. For example, it may be fabricated by casting or molding, and subsequently finished using suitable finishing and/or machining techniques. Suitable materials include both metals and synthetics.

While a presently preferred embodiment of the invention has been illustrated and described, it should be appreciated that principles of the invention apply to all embodiments falling within the scope of the following claims.

What is claimed is:

1. An internal combustion engine comprising:

a head for multiple engine cylinders, an intake manifold assembled to the head, separate fuel and air manifolds cooperatively defined between confronting surfaces of the head and the intake manifold for conveying fuel and air to the cylinders, and a leak groove in one of the confronting surfaces between the fuel manifold and the air manifold for shunting away from the air manifold any fuel leaking from the fuel manifold between the confronting surfaces toward the air manifold.

2. An engine as set forth in claim 1 wherein the leak groove is in the confronting surface of the intake manifold.

3. An engine as set forth in claim 1 wherein the leak groove is in the confronting surface of the head.

4. An engine as set forth in claim 1 wherein the leak groove comprises respective leak grooves in both confronting surfaces.

5. An engine as set forth in claim 4 including a seal having two endless loops for sealing around the fuel manifold and the air manifold respectively between the confronting surfaces, wherein the two loops share a common run that covers both respective leak grooves.

6. An internal combustion engine comprising:

a head for multiple engine cylinders comprising multiple fuel ports, each of which serves to convey fuel to at least one cylinder, and multiple air ports, each of which serves to convey air to at least one cylinder, an intake manifold assembled to the head and comprising a walled hollow interior space bounded by a perimeter flange portion that is fit to a surface of the head containing the air ports so that the hollow interior space forms a runnerless air manifold for the air ports, the intake manifold further comprising a fuel manifold defined by a bore running lengthwise within the perimeter flange portion of the intake manifold and holes that communicate with the bore at spaced apart locations along the length of the bore for conveying fuel from the bore to the fuel ports in the head.

7. An engine as set forth in claim 6 wherein the perimeter of the intake manifold and the head comprise respective confronting surfaces between which a seal is sandwiched, the seal comprising two endless loops for sealing respectively around the air manifold and around a zone of the confronting surface of the intake manifold that contains the holes for conveying fuel from the bore to the fuel ports in the head.

8. An engine as set forth in claim 7 wherein the two endless loops of the seal comprise two separate seals.

9. An engine as set forth in claim 7 wherein the two endless loops of the seal comprise a single seal in which the two loops share a common run.

* * * * *